US007901234B2

(12) United States Patent
Jedlitschka

(10) Patent No.: US 7,901,234 B2
(45) Date of Patent: Mar. 8, 2011

(54) CONNECTING PLUG FOR A HIGH-VOLTAGE CABLE

(75) Inventor: Hans Jedlitschka, Buc (FR)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 12/267,919

(22) Filed: Nov. 10, 2008

(65) Prior Publication Data

US 2009/0130883 A1 May 21, 2009

(30) Foreign Application Priority Data

Nov. 15, 2007 (FR) ..... 07 59067

(51) Int. Cl.
*H01R 13/52* (2006.01)

(52) U.S. Cl. ..... 439/281

(58) Field of Classification Search ..... 439/281, 439/282, 750, 738, 271, 275, 587, 181; 174/84 C, 174/84 R, 103, 107
See application file for complete search history.

(56) References Cited

U.S. PATENT DOCUMENTS

| | | | | |
|---|---|---|---|---|
| 2,353,719 | A | 7/1944 | Goldfield et al. | |
| 4,601,528 | A * | 7/1986 | Spier | 439/148 |
| 4,605,272 | A * | 8/1986 | Myers et al. | 439/281 |
| 4,637,674 | A | 1/1987 | Kobler | |
| 4,986,764 | A * | 1/1991 | Eaby et al. | 439/275 |
| 6,599,144 | B1 | 7/2003 | Schumann et al. | |
| 6,641,421 | B1 * | 11/2003 | Leavitt et al. | 439/271 |
| 2002/0076965 | A1 | 6/2002 | Lux et al. | |

FOREIGN PATENT DOCUMENTS

| | | |
|---|---|---|
| FR | 2 879 031 | 6/2006 |
| NL | 9401984 | 7/1996 |
| WO | WO 02/071548 | 9/2002 |

* cited by examiner

*Primary Examiner* — Alexander Gilman
(74) *Attorney, Agent, or Firm* — Global Patent Operation; Jonathan E. Thomas

(57) ABSTRACT

A plug for the connection of a high-voltage cable. The plug comprises a jacket configured to be inserted into a connection receptacle of a high-voltage electrical appliance in order to connect the cable to the appliance, wherein the jacket includes a recess created therein, and a sleeve positioned around the jacket to form an insulating interface between the jacket and the receptacle, with the sleeve being located in the recess of the jacket and configured to hold the sleeve on the jacket.

10 Claims, 3 Drawing Sheets

CONNECTING PLUG FOR A HIGH-VOLTAGE CABLE

CROSS-REFERENCE TO RELATED APPLICATIONS

This application claims priority under 35 U.S.C. §119(a)-(d) to prior-filed, co-pending French patent application serial number 0759067, filed on Nov. 15, 2007, which is hereby incorporated by reference in its entirety.

BACKGROUND OF THE INVENTION

1. Field of the Invention

The field of the invention concerns a connecting plug for a high-voltage cable.

2. Description of Related Art

In the field of medical diagnostic X-ray equipments, special connecting devices are provided for electrically connecting an appliance, such as an X-ray source for example, to a generator of high-voltage power.

Standards exist to specify the electrical and structural constraints that must be fulfilled by these connecting devices.

In particular, the XR-7 standard, established by the NEMA (National Electrical Manufacturers Association) for power-supply voltages of between 10 kV (kilovolts) and 200 kV, specifies constraints of shape and geometrical dimensions that must be fulfilled by the different components of connecting devices.

Compliance with these standards allows interoperability to be provided between the generators of high-voltage power and the different medical appliances requiring a high-voltage power supply.

A connecting device typically has two separable parts, namely a male part (known also as a plug), which constitutes one end of the high-voltage cable, and a female part (also called a receptacle or a socket), which is fixed in a permanent manner to the casing of the generator or of the equipment to be supplied, and designed to receive the male part. In order to withstand high voltages, the receptacle and the plug are made from rigid and electrically insulating materials. The receptacle and the plug have shapes and dimensions that are imposed by the standards.

The plug and the receptacle must be insulated from each other in order to avoid the formation of electrical arcs between the receptacle, the plug and the metallic envelopes of the cable forming an earth.

At the present time, the electrical insulation between the plug and the receptacle is generally achieved by means of an insulating liquid. The space that exists between the plug and the receptacle is filled with a liquid insulator, such as oil or grease for example.

In practice, the use of an insulating liquid raises certain problems.

In particular, the introduction of oil or of grease is a difficult operation since it requires a total absence of air bubbles or of polluting conducting particles between the plug and the receptacle.

In addition, there is always a risk that the operator who makes the connection will forget to inject the liquid insulator or will do so imperfectly.

Moreover, the presence of an insulating liquid imposes a substantially vertical orientation of the connecting device during fitting and removal.

In operation, the connecting device can be at a relatively high temperature. The differences in thermal expansion between the different components of the device, including the liquid insulator, give rise to a potential risk of breaking the seal of the device, which can lead to leakage of the liquid insulator and, as a consequence, deterioration of the electrical insulation.

Finally, the sealing problems arise even more in the case of radiological appliances whose X-ray source, powered at high voltage, is in motion. This is the case, for example, of computed tomography (CAT scan) appliances in which the X-ray source is rotated around the patient. The movement of the source favours the leakage of liquid insulator, in the event of a poorly sealed connection.

Document FR 2 879 031 A1 proposes replacement of the liquid insulator by an insulating interface in the form of a sleeve made of a flexible insulating material, such as a silicone elastomer for example. The interface includes segments that have elongated rings separated by air chambers.

This type of interface is particularly suitable for connecting devices of small size, but is not suitable for connecting devices of large dimension, of the type that are specified by the XR-7 standard.

In fact, with connecting devices that have a large longitudinal dimension, the sleeve of flexible material has a tendency to slide along the plug and to deform during insertion of the plug into the receptacle. The consequence is to render difficult the insertion of the plug into the receptacle and to result in incorrect positioning of the sleeve in the connecting device.

BRIEF DESCRIPTION OF THE INVENTION

One aim of the invention is to propose a means of electrical insulation that is more suitable for connecting devices of large dimension.

This problem is solved in the context of the present invention by virtue of a connecting plug for high-voltage cable, which includes:

- a jacket that is intended to be inserted into a connection receptacle of a high-voltage electrical appliance to connect the cable to the appliance, the jacket including a recess created in the jacket, and
- a sleeve positioned around the jacket to form an insulating interface between the jacket and the receptacle, the sleeve being located in the recess of the jacket in order to maintain the sleeve on the jacket.

The recess provided in the jacket holds the sleeve in place on the jacket, and ensures correct initial positioning of the sleeve on the jacket.

In addition, the recess serves to limit the sliding of the sleeve in relation to the jacket during insertion of the plug into the receptacle.

Preferably, the plug includes a multiplicity of sleeves, and the jacket includes a multiplicity of recesses, with each recess accommodating a sleeve.

Because the plug is fitted with a multiplicity of separate sleeves, held individually in recesses, each sleeve can be of a length that is less than the total length of the plug. This limits the risk of deformation of the sleeves during insertion of the plug into the receptacle.

Depending on the embodiment, the plug can also have any one of the following characteristics:

- the sleeves are placed one after the other along a longitudinal direction of the jacket,
- each sleeve includes a multiplicity of beadings that are intended to make contact with the connection receptacle,
- the beadings are of a generally annular shape,
- the beadings are of a generally helical shape, at least one of the beadings include slots allowing passage of air through the beadings, the beadings are positioned to form spaces between them that are filled with air, each space being located between two successive portions of beading, each sleeve is made in one piece from a silicone-based elastic material, the plug includes two sleeves, with each sleeve extending over approximately a third of a longitudinal dimension of the jacket, the plug has three sleeves, with each sleeve extending over approximately a quarter of a longitudinal dimension of the jacket, the jacket includes a multiplicity of recesses, shaped by smaller-diameter portions of the jacket, with these portions having diameters that decrease along a longitudinal direction of the plug.

BRIEF DESCRIPTION OF THE DRAWINGS

Other characteristics and advantages of the invention will emerge from the description that follows, the latter being purely illustrative and non-limiting, and should be read with reference to the attached figures, in which.

DETAILED DESCRIPTION

Figure 1:
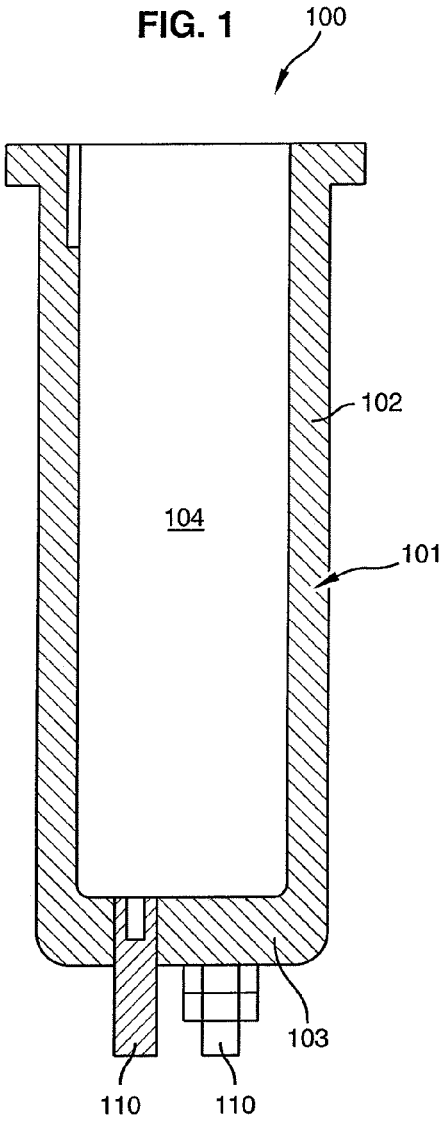
FIG. 1 represents, schematically and in longitudinal section, a receptacle of a high-voltage connecting device according to a first embodiment of the invention.
Figure 2:
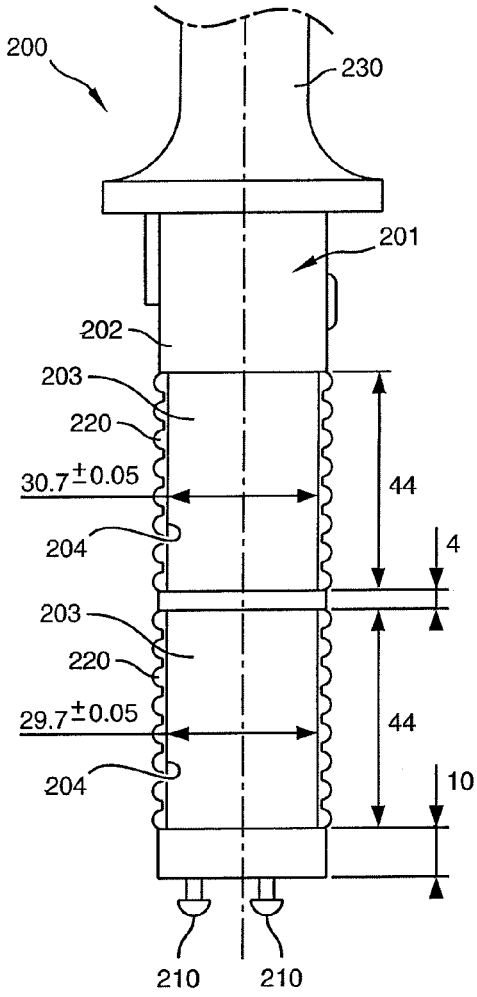
FIG. 2 represents, schematically and in longitudinal section, a plug of the connecting device according to the first embodiment of the invention.

FIGS. 1 and 2 depict an embodiment of a high-voltage connecting device that is configured in accordance with the XR-7 standard. This device is typically intended to be subjected to high voltages, of the order of 100 to 150 kilovolts, and generally of the order of 120 kilovolts.

The connecting device includes two separable parts, namely a first female part or receptacle 100, and a second male part or plug 200 designed to be accommodated in the female part 100 in order to create an electrical connection.

The receptacle 100 is typically intended to be fixed to an appliance that is working at high voltage, such as an X-ray source of a radiological imaging device, or to a high-voltage generator designed to power such an appliance.

The receptacle 100 comprises a hollow body 101 made from a rigid and insulating material (such as a plastic for example) and a multiplicity of connectors 110 made from a conducting material (such as a metal). The body 101, of generally cylindrical shape, includes a cylindrical wall 102 and a bottom 103 to create a cavity 104 to receive the plug 200. The connectors 110 pass through the bottom 103 of the body, between the cavity 104 and the exterior of the receptacle 100.

The plug 200 is configured to be fixed to one end of a high-voltage power cable used for electrical connection of a high-voltage generator to an appliance.

The plug 200 includes a jacket 201 made from a rigid and insulating material (such as a plastic for example), a multiplicity of connectors 210 made from a conducting material (such as a metal), and two removable sleeves 220 made from a flexible and insulating material (such as a silicone-based material for example).

The jacket 201 includes a body 202 that accommodates an end portion of a high-voltage cable 230. The body 202 has a generally cylindrical shape, and is configured to be located in the cavity 104 of the receptacle 100.

The connectors 110 of the receptacle 100 and the connectors 210 of the plug 200 are arranged so that, when the plug 200 is inserted into the receptacle 100, each connector 210 is brought into contact with a corresponding connector 110, so as to electrically connect the cable to the high-voltage generator or to the equipment.

The sleeves 220 are placed one after the other along a longitudinal direction of the jacket 201.

The body 202 includes two sections 203 which have a diameter that is less than the outside diameter of the body. The sections 203 of smaller diameter form recesses 204, with each recess 204 being designed to receive a sleeve 220. Each recess 204 is used to keep the sleeve 220 in place during insertion of the plug 200 into the receptacle 100.

The recesses 204 prevent the sleeves from sliding along the jacket 201 during insertion.

Preferably, each sleeve 220 (and each corresponding recess 204) extends over about a third of a longitudinal dimension of the jacket 201.

Figure 3:
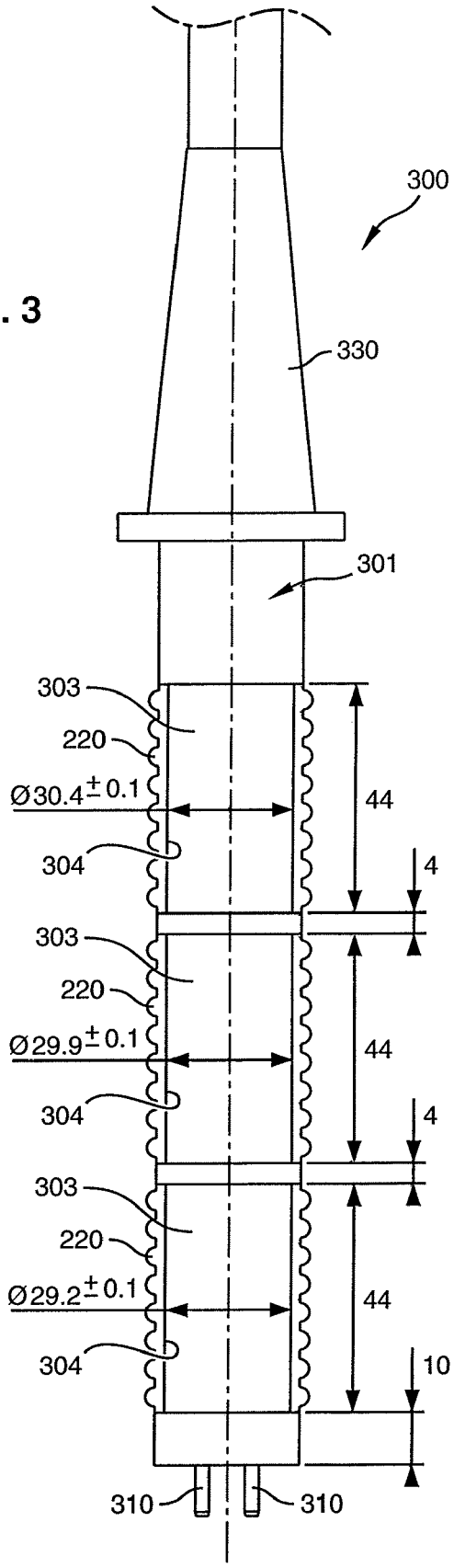
FIG. 3 represents, schematically and in longitudinal section, a plug of a connecting device according to a second embodiment of the invention.

FIG. 3 represents a plug 300 of a high-voltage connecting device according to a second embodiment of the invention. In this second embodiment, the plug has a larger longitudinal dimension than the plug of the connecting device of FIGS. 1 and 2. According to this second embodiment, the device is typically intended to be subjected to high voltages, of the order of 200 kilovolts.

The plug 300 is configured to be fixed to one end of a high-voltage power cable used for the electrical connection of a high-voltage generator to an appliance.

The plug 300 includes a jacket 301 made from a rigid insulating material (such as a plastic for example), a multiplicity of connectors 310 made from a conducting material (such as a metal), and three removable sleeves 220 made from a flexible and insulating material (such as a silicone-based material for example).

The jacket 301 includes a body 302 that accommodates an end portion of a high-voltage cable 330. The body 302 has a generally cylindrical shape and is configured to be located in a cavity of a receptacle (not shown).

The sleeves 220 are placed one after the other along a longitudinal direction of the jacket 301.

The body 302 includes three sections 303 that have a diameter less than the outside diameter of the body. The sections 303 of smaller diameter form recesses 304, each recess 304 being designed to receive a sleeve 220. Each recess 304 is used to keep the sleeve 220 in place during insertion of the plug 300 in the receptacle.

The recesses 304 prevent the sleeves from sliding along the jacket 301 during insertion.

Preferably, each sleeve 220 (and each corresponding recess 304) extends for about a quarter of a longitudinal dimension of the jacket 301.

As can be seen from FIGS. 2 and 3, the sections 203, 303 of smaller diameter have a diameter that decreases slightly along the plug in the longitudinal direction of the plug, from one end of the cable to the end carrying the connectors. This reduction is due to the slightly tapered shape of the cavity of the receptacle.

The sleeves all have the same inside diameter. The elasticity of the sleeves allow the latter to adapt to recesses of dimensions that vary slightly.

Figure 4:
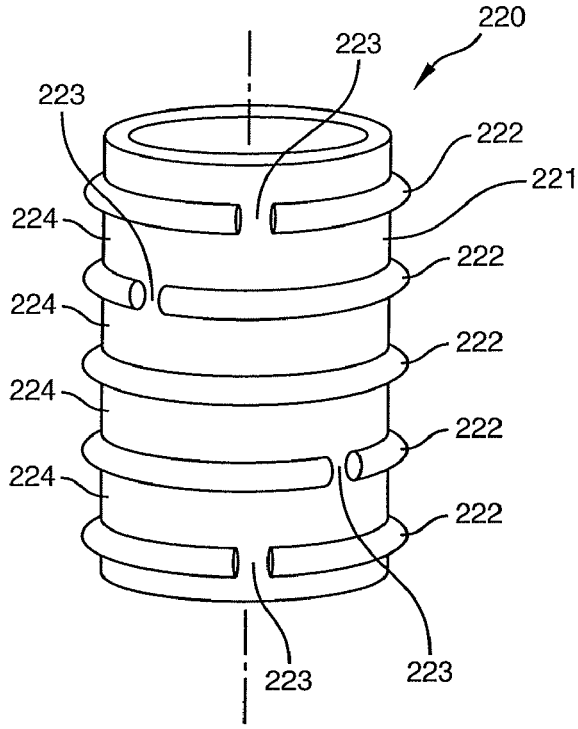
FIG. 4 represents, schematically and in perspective, an insulating sleeve of a first type.
Figure 5A:
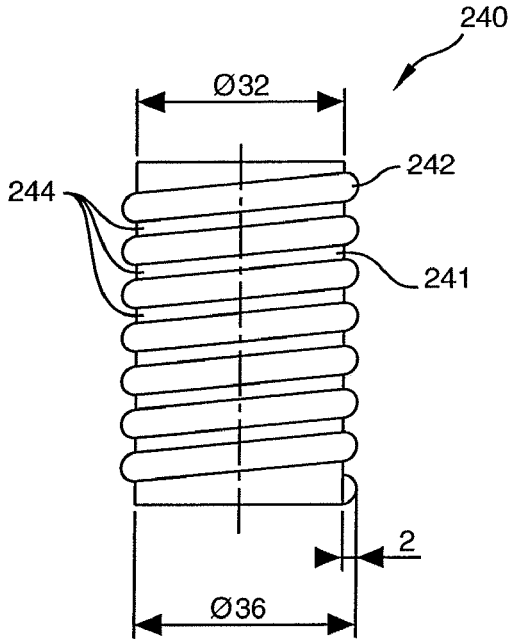
FIGS. 5A and 5B represent, schematically and respectively in side and perspective views, an insulating sleeve of a second type.
Figure 5B:
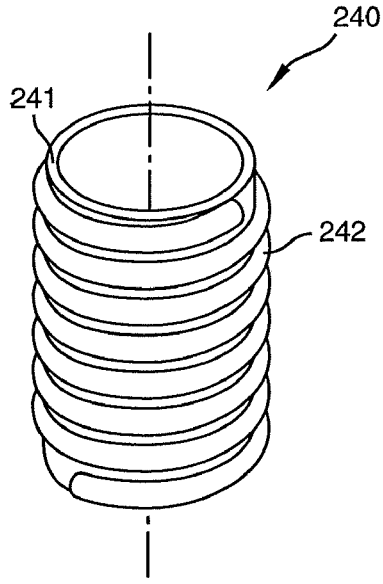

FIGS. 4, 5A and 5B represent two types of sleeve that can be used in the context of this present invention.

In FIG. 4, the sleeve 220 represented is made in one piece. The sleeve 220 includes a cylindrical tube 221 and a multiplicity of annular beadings 222 positioned around the tube 221.

The beadings 222 are intended to make contact with the inner surface of the wall 102 of the receptacle when the plug 200 is inserted into the receptacle 100. In this configuration, the body 201 of the plug 200 is held at a distance from the body 101 of the receptacle 100 by means of the sleeves 220. In addition, the beadings 222 form spaces 224 between them that are filled with air, thus contributing to the electrical insulation of the plug 200 and the receptacle 100.

The receptacle 100 and the plug 200 are therefore insulated from each other firstly by the beadings 222 and secondly by the air-filled spaces 224.

Each annular beading 222 is interrupted by a slot 223 that allows the passage of air through the beading 222. Each slot allows communication between two successive air spaces 224.

The insertion of the plug 200 into the receptacle 100 is facilitated by the presence of the slots 223, which allow the air initially contained in the cavity 104 of the receptacle 100 to escape when the plug 200 is inserted into the receptacle 100.

In FIGS. 5A and 5B, the sleeve 240 represented is made in one piece. The sleeve 240 includes a cylindrical tube 241 and one or more helical beadings 242 positioned around the tube 241.

The beading or beadings 242 are intended to make contact with the inner surface of the wall of the receptacle when the plug is inserted into the latter. In this configuration, the body of the plug is held at a distance from the body of the receptacle by means of the sleeves 240. In addition, the turns of the beadings 242 form spaces between them 244 that are filled with air, thus contributing to the electrical insulation of the plug and the receptacle.

The receptacle and the plug are therefore insulated from each other firstly by the beadings 242 and secondly by the air-filled spaces 244.

The helical shape of the beading or beadings 242 allow the air initially contained in the cavity of the receptacle to escape when the plug is inserted into the receptacle.

However, the turns of the beading 242 can be equipped with slots (as in the sleeve of FIG. 4 so as to further facilitate the removal of the air.

The helical shape of the beading or beadings 242 result in greater dielectric strength of the sleeve. As a consequence, the sleeve 240 of FIGS. 5A and 5B provides better electrical insulation than the sleeve 220 of FIG. 4.

The sleeve 240 can be used in place of the sleeve 220 used in the connecting devices of FIGS. 1, 2 and 3.

Since each sleeve 220, 240 is elastic, it can be replaced easily in the event of damage. This allows easy maintenance of the connecting device.

In addition, this can be useful in the case where the plug 200, 300 is used with a receptacle of a connecting device of prior art.

On making contact with oil, whether mineral or synthetic, the silicone sleeve expands, since one of the advantages of the sleeves that have just been described arises from the fact that the air-filled spaces constitute so many spaces that contribute to this expansion. As a consequence, despite the accidental presence of oil in the receptacle, the male part (the plug) will continue to be easily fitted to and removed from the female part (the receptacle). This would not be the case if the sleeve were solid, since then the sleeve would have no space for expansion, leading to jamming of the expanded sleeve in the receptacle.

Moreover, since it is not necessary to fill the receptacle with a liquid insulator, the receptacle can be oriented in a variety of directions, providing greater freedom in the positioning of the receptacle on the high-voltage generator or the equipment.

Finally, the replacement of the conventional insulating liquids by an insulator in the form of a removes the risk of leakage, which is particularly advantageous in the case of radiological imaging appliances in which the source, powered at high voltage, is rotated around the patient.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the scope of the following claims.

The invention claimed is:

1. A plug for connecting a high-voltage cable to a receptacle for connection of the high-voltage cable to a high-voltage electrical appliance, said plug comprising:

a jacket comprising an elongated body having a first recess created in the jacket; and a sleeve removably positioned around the jacket to form an insulating interface between the jacket and the receptacle, the sleeve comprising a cylindrical tube and a beading disposed on an outer surface of the cylindrical tube and separating the elongated body from the receptacle, wherein the first recess comprises an area having a first diameter, wherein the area is bounded on opposite sides by portions of the elongated body, wherein each portion of the elongated body has a second diameter that is larger than the first diameter, and wherein the sleeve is located in the first recess and is sized to fit between the portions of the elongated body in order to maintain the sleeve on the jacket.

2. A plug according to claim 1, further comprising:

a second recess created in the jacket; and a second sleeve located in the second recess, wherein the sleeves are placed one after the other along a longitudinal direction of the jacket.

3. A plug according to claim 1, wherein the beading is configured to make contact with a cylindrical wall of the receptacle.

4. A plug according to claim 1, wherein the beading comprises a plurality of rings that are disposed longitudinally along the length of the cylindrical tube.

5. A plug according to claim 1, wherein the beading forms a helix about the outer surface of the sleeve.

6. A plug according to claim 1, wherein the beading includes a slot that communicates air to through the beading.

7. A plug according to claim 4, wherein the rings are spaced from one another to form spaces between two successive rings, and wherein the spaces are filled with air.

8. A plug according to claim 1, wherein the sleeve comprises one piece of a silicone-based elastic material.

9. A plug according to claim 1, wherein the first diameter decreases longitudinally along the elongated body.

10. A plug according to claim 1, wherein the sleeve extends over approximately a third of the elongated body.

* * * * *